US006305916B1

(12) United States Patent
Reinert

(10) Patent No.: US 6,305,916 B1
(45) **Date of Patent: *Oct. 23, 2001**

(54) CONCRETE PUMP WITH PIVOTABLE HOPPER ASSEMBLY

(75) Inventor: Gerald H. Reinert, Cold Spring, KY (US)

(73) Assignee: Gerald Reinert, Florence, KY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/229,280

(22) Filed: Jan. 13, 1999

(51) Int. Cl.[7] ..... F04B 39/00; F04B 7/00; F04B 15/02

(52) U.S. Cl. ..... 417/454; 417/516; 417/900

(58) Field of Search ..... 417/900, 516, 417/570, 454, 234

(56) References Cited

U.S. PATENT DOCUMENTS

| | | | | |
|---|---|---|---|---|
| 3,146,721 | * | 9/1964 | Schwing | 103/49 |
| 3,612,730 | | 10/1971 | Reinert | 417/507 |
| 3,639,086 | * | 2/1972 | Robbins | 417/454 |
| 3,650,641 | | 3/1972 | Reinert | 417/518 |
| 3,741,078 | * | 6/1973 | Johnson | 92/244 |
| 3,778,193 | | 12/1973 | Reinert | 417/342 |
| 3,811,802 | * | 5/1974 | Semple | 417/454 |
| 3,897,180 | | 7/1975 | Reinert | 417/517 |
| 4,019,839 | * | 4/1977 | Schwing | 417/517 |
| 4,198,193 | * | 4/1980 | Westerlund et al. | 417/339 |
| 4,241,641 | | 12/1980 | Reinert | 91/189 |
| 4,437,817 | * | 3/1984 | Metzelder | 417/507 |
| 4,502,851 | * | 3/1985 | Calvin et al. | 417/516 |
| 4,533,300 | * | 8/1985 | Westerlund et al. | 417/339 |
| 4,563,135 | * | 1/1986 | Riker | 417/517 |
| 5,061,158 | * | 10/1991 | Egli | 417/532 |

OTHER PUBLICATIONS

Grainger, General Catalog #308; Addison, 1130 Fullerton Ave, 60101; p. 1747, Dec. 1991.*
Schwing Catalog pages published before 1998?.
Reinert Concrete Pumps Catalog published before 1998?.
Reinert Concrete Pumps Parts Drawing for S–Tube Valve Assembly for Model 530 published before 1998?.

* cited by examiner

*Primary Examiner*—Charles G. Freay
*Assistant Examiner*—Timothy P. Solak

(57) ABSTRACT

The hopper of a concrete pump is pivotally mounted on the frame of the pump so that the hopper can be swung away from the pumping cylinders in order to clean the S-valve in the hopper. O-rings on the frame surround the pumping cylinders and sealingly engage the hopper when the hopper is closed against the pumping cylinders.

8 Claims, 5 Drawing Sheets

CONCRETE PUMP WITH PIVOTABLE HOPPER ASSEMBLY

BACKGROUND

This invention relates to concrete pumps, and, more particularly, to a concrete pump with a pivotable S-valve and hopper assembly.

Concrete pumps are well known in the construction industry and are used for pumping concrete or other pumpable construction materials. Concrete pumps are described, for example, in U.S. Pat. Nos. 3,612,730, 3,897,180, and 4,241,641.

Most concrete pumps which are currently being manufactured include two concrete pumping cylinders and an S-shaped tube valve for alternately connecting the outlet end of each pumping cylinder to the discharge conduit of the concrete pump. The S-tube valve is pivotally mounted in a concrete hopper. As the piston in one of the pumping cylinders moves toward the hopper to pump concrete through the S-tube valve to the discharge conduit, the piston in the other pumping cylinder retracts away from the hopper to draw concrete into the cylinder.

A major problem with the S-tube valve is clean-up. Material builds up and hardens in the bottom or inlet end of the tube, and the hardened material is difficult to remove because of the curved shape of the tube. The problem is particularly acute with small diameter S-tubes.

The curved tube also makes it difficult to service the outlet end of the pumping cylinders. The pumping pistons carry seals which must be changed from time to time.

SUMMARY OF THE INVENTION

The invention pivotally mounts the hopper and S-tube valve assembly on the frame or chassis of the concrete pump so that the hopper and valve can swing away from the outlet ends of the pumping cylinders. The inlet end of the S-tube valve is thereby exposed for easy cleaning. The outlet ends of the pumping cylinders are also exposed to permit the piston seals to be changed. When the S-tube valve and hopper assembly is pivoted to its closed position against the outlet ends of the cylinders, the assembly is quickly and easily locked in place by two bolts. O-rings which surround the cylinders sealingly engage the hopper to prevent the concrete from leaking.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
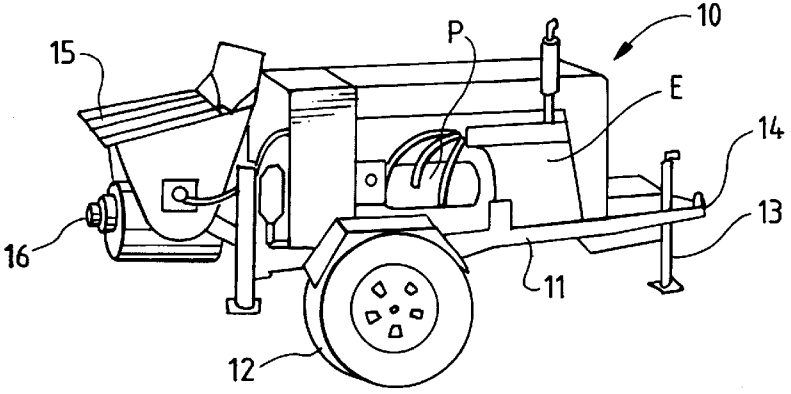
FIG. 1 is a perspective view of a prior art concrete pump.

Referring to FIG. 1, a conventional prior art concrete pump 10 includes a frame or chassis 11 which is mounted on wheels 12. The front end of the pump is supported by a retractable stand 13, and the pump can be towed by a trailer hitch 14.

A hopper 15 at the rear end of the pump can be filled with concrete or other material to be pumped. The concrete is pumped through a discharge conduit 16 which is mounted in an opening in the back wall of the hopper.

Figure 2:
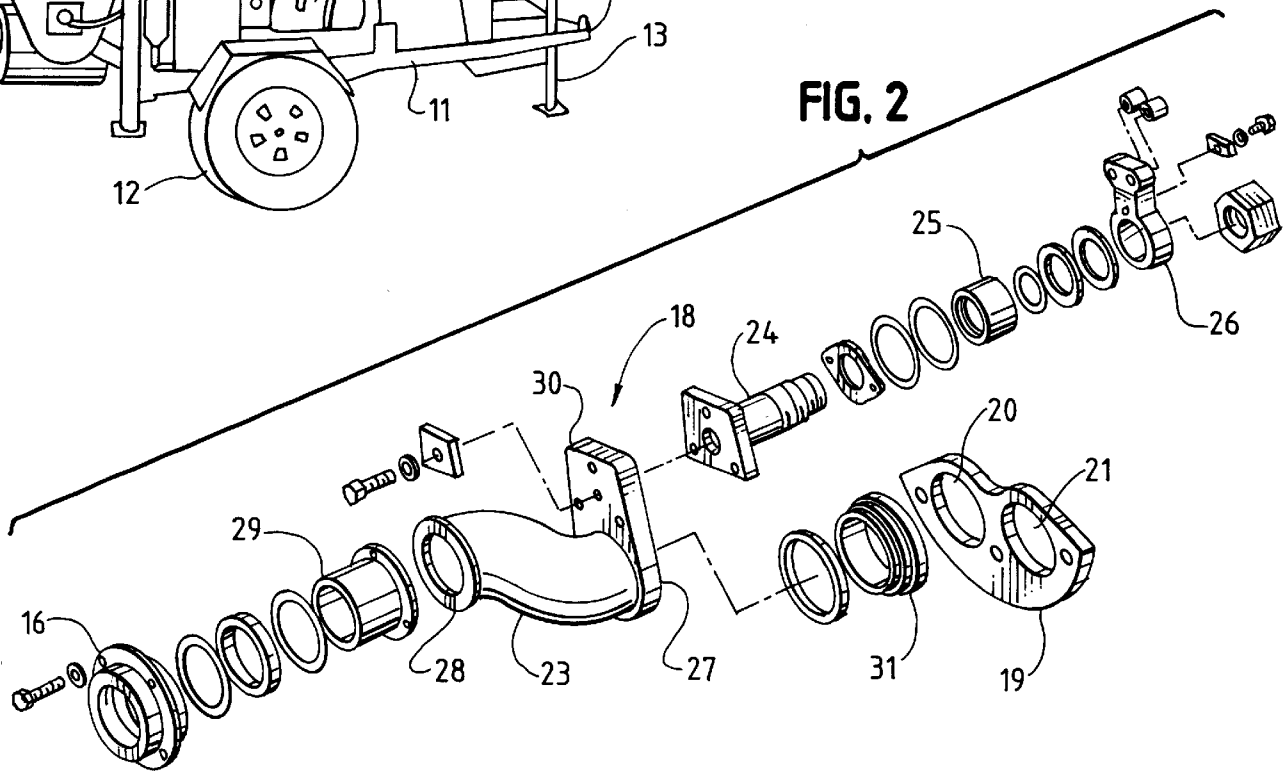
FIG. 2 is an exploded perspective view of the S-tube valve assembly of the concrete pump of FIG. 1.

As is well known in the art, the front wall of the hopper is provided with a pair of openings, and a valve assembly 18 (FIG. 2) is mounted inside of the hopper. The valve assembly includes a wear plate 19 which is attached to the inside surface of the front wall of the hopper. The wear plate is provided with a pair of openings 20 and 21 which are aligned with the openings in the hopper.

An S-shaped tube valve 23 is pivotally mounted inside of the hopper by a trunnion or main shaft 24 which extends through a bearing 25 which is mounted in an opening in the front wall of the hopper. The trunnion is rotated by a crank arm 26 and by two hydraulic cylinders which are attached to the crank arm.

The S-tube valve 23 includes inlet and outlet ends 27 and 28. The outlet end 28 is connected to an S-tube extension 29 which rotates within the discharge conduit 16. The inlet end 27 is connected to the trunnion 24 by a mounting plate 30, and a wear ring 31 is attached to the plate 30. The inlet end is swung back and forth between the two openings in the hopper by hydraulic cylinders.

Two concrete pumping cylinders are aligned with the openings in the hopper. The S-tube is rotated by the trunnion 24 into alignment with the pumping cylinder which is full of concrete. The piston in that cylinder is then forced toward the hopper to force the concrete from the cylinder, through the valve, and out of the discharge conduit 16. As one piston pumps concrete through the valve, the other piston retracts away from the hopper to draw concrete from the hopper through the opening which is not aligned with the S-tube valve.

Each of the pumping pistons is driven by a hydraulic piston and cylinder assembly as described in the aforementioned patents. A hydraulic pump P on the chassis is powered by an internal combustion engine E.

The hopper 15 of prior art concrete pumps is mounted in a stationary position on the chassis of the pump. Access to the S-tube valve 23 is provided only through the outlet end 28. Because of the S curve in the valve, it is difficult to clean the inlet end 27 of the valve. The cleaning difficulty increases as the diameter of the valve decreases.

Figure 3:
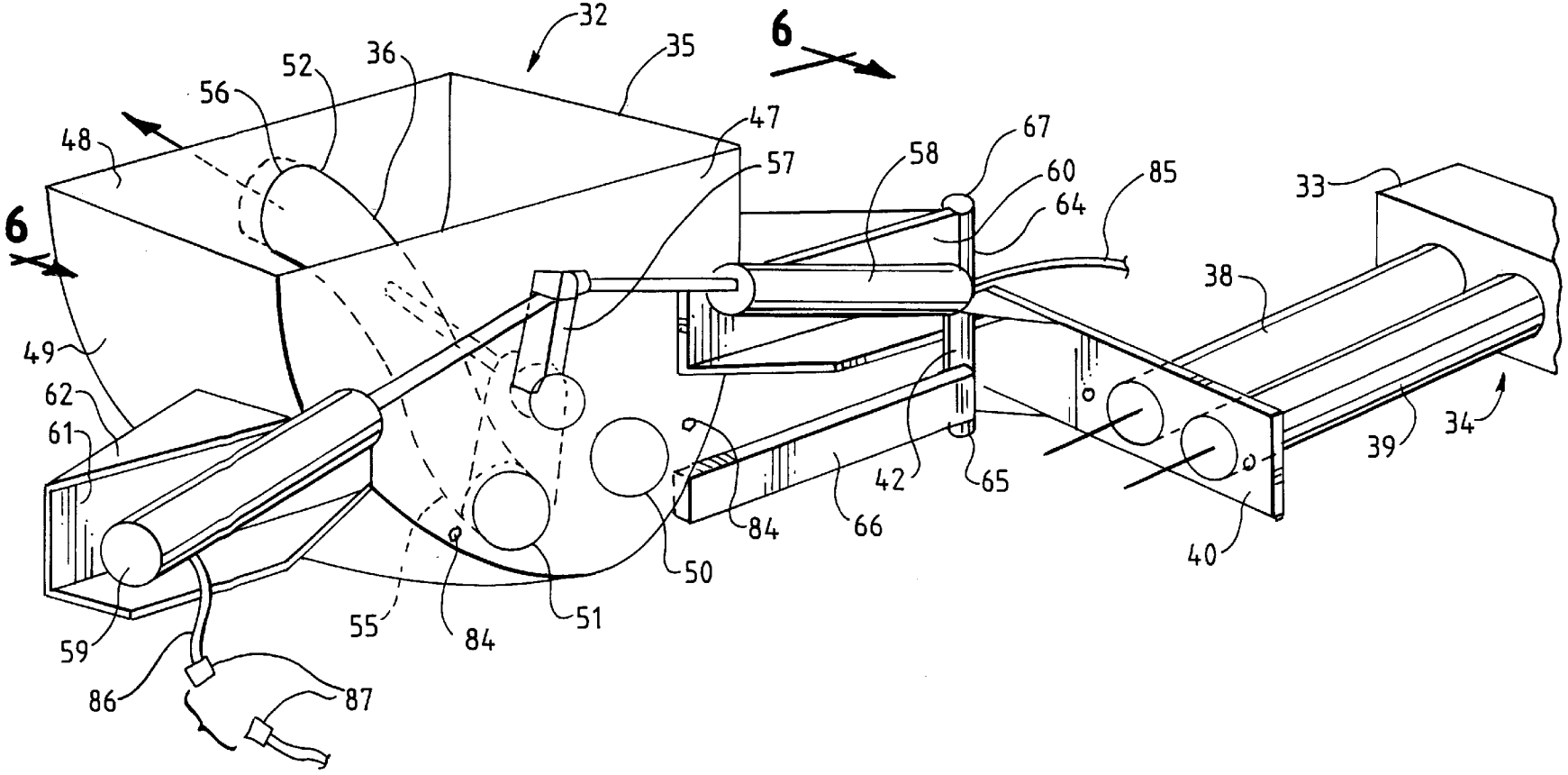
FIG. 3 is a fragmentary perspective view of a concrete pump which is formed in accordance with the invention.

Referring now to FIG. 3, a hopper assembly 32 is pivotally mounted on a frame or chassis 33 of a concrete pump 34. The hopper assembly is illustrated in its open position in FIG. 3, and the front of hopper 35 is swung away from the chassis to provide access to the inlet end of S-tube valve 36.

The concrete pump can be constructed in the conventional manner except for the structure which pivotally mounts and seals the hopper assembly on the chassis. The pump includes two parallel concrete pumping cylinders 38 and 39 which are mounted on the chassis.

The rear ends of the cylinders extend through a rear mounting plate 40 which is mounted on the chassis and extends transversely across the chassis and perpendicular to the axes of the cylinders. A vertical pivot tube 42 (see also FIGS. 4–6) is welded to the rear plate 40 and is reinforced by two gusset plates 44.

The hopper assembly 32 includes a conventionally shaped hopper 35 which includes front and rear walls 47 and 48 and a U-shaped intermediate wall 49. A pair of openings 50 and 51 are provided in the front wall 47, and an outlet opening 52 is provided in the rear wall 48.

A conventional S-tube valve 36 is mounted inside of the hopper. The S-tube valve includes an inlet end 55 and an outlet end 56. The outlet end is rotatably mounted relative to the outlet opening 52, and the inlet end is swung back and forth between the openings 50 and 51 by a crank arm 57 which is pivoted by hydraulic cylinders 58 and 59. The hydraulic cylinders are pivotally mounted on angles 60 and 61 which are attached to the hopper. The angles are reinforced by gussets 62.

An upper pivot tube 64 is mounted on the angle 61 (see also FIG. 6), and a lower pivot tube 65 is mounted on a bar 66 which is attached to the front wall 47 of the hopper. The pivot tube 42 on the chassis is positioned between the upper and lower pivot tubes 64 and 65 to form a hinge, and the tubes are pivotally connected by a hinge pin or pivot pin 67.

FIG. 3 illustrates the hopper in an open position in which the hopper is swung away from the chassis to provide access to the inlet end of the S-tube valve and to the rear ends of the pumping cylinders 38 and 39. When the hopper is open, the inlet end of the valve can be cleaned, and the seals on the pumping pistons can be changed.

Figure 6:
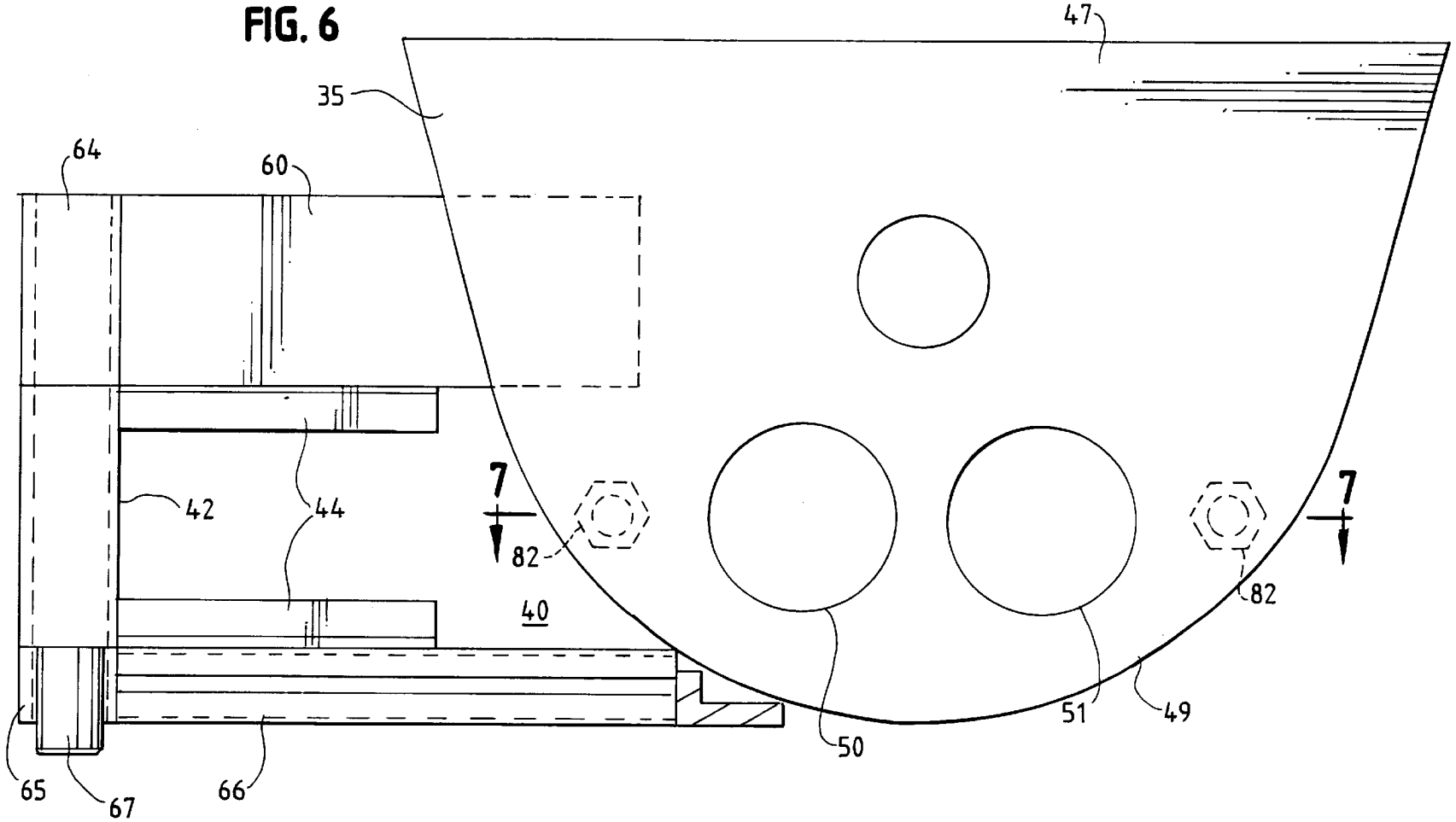
FIG. 6 is a fragmentary sectional view as would be seen along the line 6—6 of FIG. 3 when the hopper is closed against the rear plate on the frame.
Figure 7:
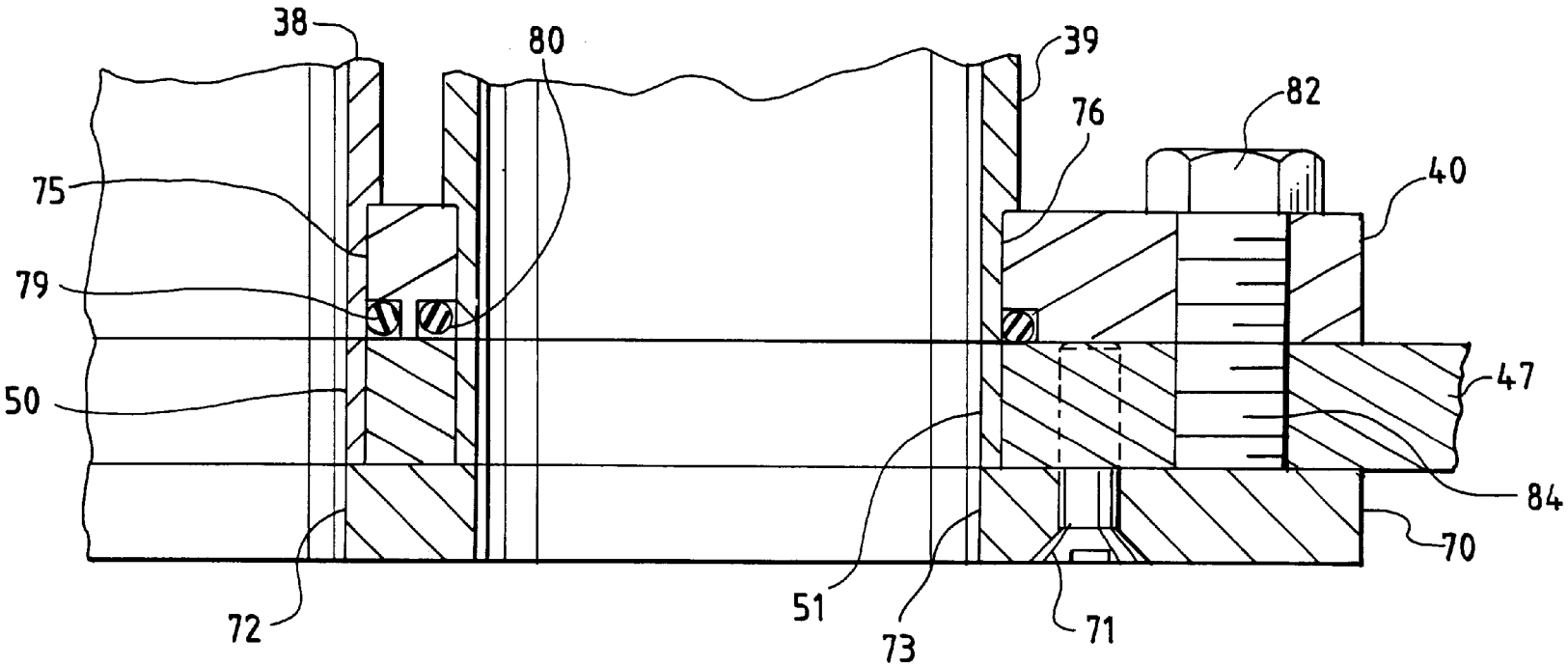
FIG. 7 is a fragmentary sectional view taken along the line 7—7 of FIG. 6.

FIGS. 6 and 7 illustrate the hopper in a closed positioned in which the front wall 47 of the hopper abuts the rear plate 40 on the chassis. A wear plate 70 is attached to the inside of the front wall by screws 71 and is provided with openings 72 and 73. The openings in the wear plate and the openings 50 and 51 in the front wall 47 are aligned with the rear ends of the pumping cylinders 38 and 39.

Figure 4:
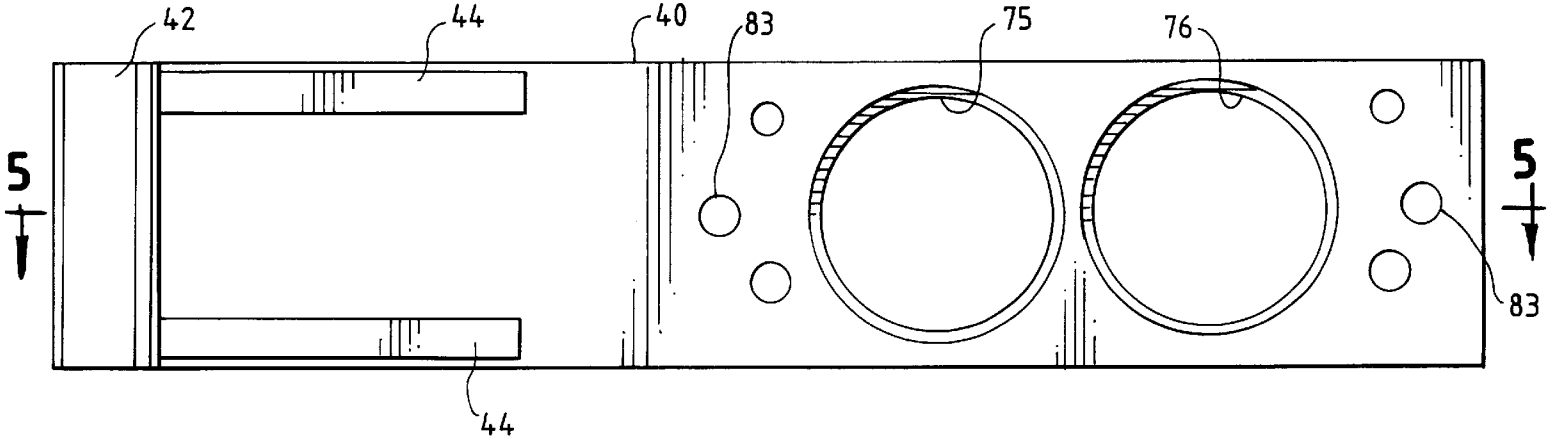
FIG. 4 is an elevational view of the rear plate on the frame through which the pumping cylinders extend.
Figure 5:
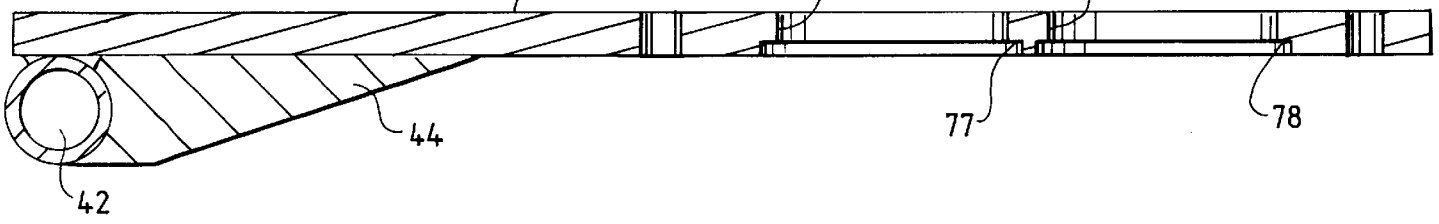
FIG. 5 is a sectional view taken along the line 5—5 of FIG. 4.

The rear ends of the pumping cylinders extend through openings 75 and 76 in the rear mounting plate 40 (see also FIGS. 4 and 5). Annular recesses 77 and 78 are provided in the rear surface of the plate 40 around the openings 75 and 76, and O-rings 79 and 80 are positioned in the recesses. When the hopper is in the closed position, the O-rings sealingly engage the hopper, plate 40, and cylinders to prevent concrete from leaking between the cylinders and the hopper.

The hopper is secured in the closed position by two bolts 82 which extend through openings 83 in the rear plate 40 and are screwed into threaded openings 84 in the front wall 47 of the hopper.

When it is desired to clean the inlet end of the S-tube valve, the bolts 82 are removed and the hopper assembly is swung away from the plate 40 by means of the hinge pin 67. The hydraulic cylinders 58 and 59 are mounted on the hopper assembly and pivot with the hopper.

The hydraulic hose 85 (FIG. 3) which connects the hydraulic cylinder 58 on the hinged side of the hopper assembly to the hydraulic pump is flexible and has sufficient length to permit the hopper to swing open. The hydraulic hose 86 (FIG. 3) which connects the hydraulic cylinder 59 to the hydraulic pump includes a quick disconnect coupling 87. The coupling permits the hopper assembly to swing open without interference from the hydraulic hose on the side opposite the hinge.

The coupling 87 also provides a safety function. When the coupling is uncoupled, the coupling closes the hydraulic flow passage between the hydraulic pump and the hydraulic cylinder 59. The hydraulic system of the concrete pump is thereby disabled, and the concrete pumping cylinders cannot be operated.

Although in the preferred embodiment, the S-valve and hopper assembly is pivotally mounted on the chassis in order to provide access to the inlet end of the S-valve, the valve and hopper assembly could be movably mounted in some other manner to provide the desired access. For example, the assembly could be slidably mounted on the chassis.

While in the foregoing specification a detailed description of specific embodiments of the invention were set forth for the purpose of illustration, it will be understood that many of the details herein given can be varied considerably by those skilled in the art without departing from the spirit and scope of the invention.

I claim:

1. A concrete pump comprising:

a frame, a hydraulic pump mounted on the frame, a pair of parallel concrete pumping cylinders mounted on the frame, each of the pumping cylinders having an outlet end, a valve and a hopper assembly pivotally mounted on the frame for movement between open and closed positions, the valve and hopper assembly including a hopper having an outlet opening and a front wall with a pair of pump openings which are aligned with the outlet ends of the pumping cylinders when the hopper assembly is in the closed position, an S-shaped valve tube pivotally mounted in the hopper and having a first end aligned with the outlet opening of the hopper and a second end which is movable between a first position in which the second end is aligned with one of the pumping openings and a second position in which the second end is aligned with the other of the pumping openings, a mounting plate on the second end of the valve tube, a shaft connected to the mounting plate and extending through the front wall of the hopper, and a crank arm attached to the shaft outside of the hopper, a hydraulic piston mounted on the valve and hopper assembly and connected to the crank arm for moving the valve tube between the first and second positions, a hydraulic hose connecting the hydraulic piston to the hydraulic pump, and a pair of O-rings on the frame, each of the O-rings surrounding the outlet end of one of the pump cylinders and being engageable with the hopper when the hopper is in the closed position for providing seals between the pumping cylinder and the pump.

2. The pump of claim 1 in which each of the pumping cylinders has a longitudinal axis and the hopper is pivotally mounted on an axis which extends perpendicularly to the axes of the pumping cylinders.

3. The pump of claim 1 in which the pump includes a plate mounted on the frame, the outlet ends of the pumping cylinders being attached to the plate and the plate having a pair of openings which are aligned with the outlet ends of the pumping cylinders, the front wall of the hopper abutting the plate when the hopper assembly is in the closed position to provide a pair of flow passages through the openings in the plate and the openings in the plate and engaging the front wall of the hopper when the hopper assembly is in the closed position.

4. The pump of claim 3 including a pair of bolts which extend through said plate and said hopper front wall when the valve and hopper assembly is in the closed position whereby the front wall of the hopper is clamped against the O-rings.

5. The pump of claim 4 in which said pumping cylinders are horizontally spaced apart, each of said bolts being positioned laterally outwardly of one of the pumping cylinders.

6. The pump of claim 3 in which said plate includes front and back surfaces, the pumping cylinders extending through the openings in the plate so that the outlet ends of the pumping cylinders are aligned with the back surface of the plate, the back surface of the plate having a pair of recesses which surround the outlet ends of the pumping cylinders, the O-rings being mounted in the recesses for engaging the front wall of the hopper when the hopper assembly is in the closed position.

7. The pump of claim 1 in which the hydraulic hose includes a first portion connected to the hydraulic piston and a second portion connected to the hydraulic pump and a quick disconnect coupling connecting the first and second hose portions.

8. A concrete pump comprising:

a frame, a hydraulic pump mounted on the frame, a pair of parallel concrete pumping cylinders mounted on the frame, each of the pumping cylinders having an outlet end, a valve and a hopper assembly pivotally mounted on the frame for movement between open and closed positions, the valve and hopper assembly including a hopper having an outlet opening and a front wall with a pair of pump openings which are aligned with the outlet ends of the pumping cylinders when the hopper assembly is in the closed position, an S-shaped valve tube pivotally mounted in the hopper and having a first end aligned with the outlet opening of the hopper and a second end which is movable between a first position in which the second end is aligned with one of the pumping openings and a second position in which the second end is aligned with the other of the pumping openings, a mounting plate on the second end of the valve tube, a shaft connected to the mounting plate and extending through the front wall of the hopper, and a crank arm attached to the shaft outside of the hopper, a hydraulic piston mounted on the valve and hopper assembly and connected to the crank arm for moving the valve tube between the first and second positions, and a hydraulic hose connecting the hydraulic piston to the hydraulic pump.

* * * * *